US005887365A

United States Patent [19]

Fujishima et al.

[11] Patent Number: 5,887,365

[45] Date of Patent: Mar. 30, 1999

[54] FRONT CONTROL SYSTEM FOR CONSTRUCTION MACHINE AND OIL TEMPERATURE INDICATOR

[75] Inventors: Kazuo Fujishima, Ibaraki-ken; Hiroshi Watanabe, Ushiku; Masakazu Haga; Takashi Nakagawa, both of Ibaraki-ken, all of Japan

[73] Assignee: Hitachi Construction Machinery Co., Ltd., Tokyo, Japan

[21] Appl. No.: 881,501

[22] Filed: Jun. 24, 1997

[30] Foreign Application Priority Data

Jun. 26, 1996 [JP] Japan ..... 8-166378

[51] Int. Cl.[6] ..... E02F 3/43

[52] U.S. Cl. ..... 37/348; 364/167.05

[58] Field of Search ..... 37/348, 902, 466; 172/2, 3, 4, 9.5, 7; 364/167.05; 123/397; 340/605, 679; 477/143, 155; 166/248, 250.15

[56] References Cited

U.S. PATENT DOCUMENTS

| | | | |
|---|---|---|---|
| 4,034,335 | 7/1977 | Harazoe et al. | 340/679 |
| 4,829,418 | 5/1989 | Nielsen et al. | 37/348 X |

FOREIGN PATENT DOCUMENTS

| | | |
|---|---|---|
| 0537349A | 2/1991 | European Pat. Off. . |
| 2-066302 | 3/1990 | Japan . |
| 4-131510 | 5/1992 | Japan . |
| 4-136324 | 5/1992 | Japan . |
| 6-146326 | 5/1994 | Japan . |
| 6-294150 | 10/1994 | Japan . |
| 9-151491 | 6/1997 | Japan . |
| WO95/30059 | 9/1995 | WIPO . |

*Primary Examiner*—Thomas B. Will
*Assistant Examiner*—Robert Pezzuto
*Attorney, Agent, or Firm*—Fay, Sharpe, Beall, Fagan, Minnich & McKee

[57] ABSTRACT

In an oil temperature detecting/calculating portion 9*p*, threshold values $T_1$, $T_2$ are set beforehand to divide a range of oil temperature into a first oil temperature range a representing the lowest level, a second oil temperature range b representing a relatively low level, and a third oil temperature range c representing a normal level. The calculating portion 9*p* executes an alarm control process for making the alarm lamp 14 light up continuously when the detected oil temperature is in the first oil temperature range a, making the alarm lamp 14 blink when it is in the second oil temperature range b, and making the alarm lamp 14 turn out when it is in the third oil temperature range c. This enables a front control system for a construction machine to perform front control accurately and safely even when the temperature of hydraulic oil is low.

10 Claims, 10 Drawing Sheets

FRONT CONTROL SYSTEM FOR CONSTRUCTION MACHINE AND OIL TEMPERATURE INDICATOR

BACKGROUND OF THE INVENTION

1. Field of the Invention

The present invention relates to a construction machine having a multi-articulated front device, and more particularly to a front control system for a construction machine, e.g., a hydraulic excavator having a front device comprising a plurality of front members such as an arm, a boom and a bucket, which system is adapted for front control, e.g., area limiting excavation control to limit an area where the front device is allowed to move for excavation. The present invention also relates to an oil temperature indicator for use in the front control system.

2. Description of the Related Art

There is known a hydraulic excavator as typical one of construction machines. In a hydraulic excavator, front members, such as a boom and an arm, making up a front device are operated by an operator manipulating respective manual control levers. However, because the front members are coupled to each other through articulations for relative rotation, it is very difficult to carry out excavation work within a predetermined area or in a predetermined plane by operating the front members. Also, when excavation work is performed in urban districts and so forth, due care must be paid to keep the front device from interfering with surrounding objects, e.g., electric wires and walls.

In view of the above-mentioned state of art, various proposals for facilitating excavation work or preventing interference between the front device and surrounding objects have been made.

For example, according to JP, A, 4-136324, a slowdown area is set in a position before reaching an entrance forbidden area, and a front device is slowed down by reducing an operation signal input from a control lever when a part, e.g., a bucket, of the front device enters the slowdown area, and is stopped when the bucket reaches the boundary of the entrance forbidden area.

Also, according to WO 95/30059, an area to be excavated is set beforehand, and a part, e.g., a bucket, of a front device is controlled to slow down its movement only in the direction toward the excavation area when the bucket comes close to the boundary of the excavation area, and to be able to move along the boundary of the excavation area without going out of the excavation area when the bucket reaches the boundary of the excavation area.

Meanwhile, in machines wherein working members are driven with hydraulic pressure, such as hydraulic excavators, a hydraulic pump is rotated by a prime mover to deliver a hydraulic fluid (oil) therefrom for driving a hydraulic actuator. As with ordinary motor vehicles, such a hydraulic machine requires warm-up operation of the prime mover at the start-up. To inform the operator of that the machine is now under the warm-up operation, therefore, an actual machine includes a thermometer for detecting a temperature of cooling water for the prime mover and a warmup lamp. The warm-up lamp is lit up when the water temperature is not higher than a predetermined value, and is turned out when it exceeds the predetermined value.

SUMMARY OF THE INVENTION

Generally, machines driven with hydraulic pressure tend to deteriorate a response in mechanical operation depending on temperature because the hydraulic oil has increased viscosity at low temperatures. This is also true in the front control system mentioned above. If the temperature of the hydraulic oil is extremely lowered, a reduction in control accuracy is resulted due to a response delay of hydraulic equipments. In the system designed to carry out the front control explained above, particularly, if a control lever is abruptly operated when a bucket end is positioned near the boundary of the set area, the bucket end may move out beyond the boundary of the set area and enter the forbidden area.

Also, as mentioned above, hydraulic machines such as hydraulic excavators include a warm-up lamp which is lit up when the temperature of cooling water for a prime mover is not higher than a predetermined value. But, cooling water for a prime mover is heated by the prime mover, whereas hydraulic oil in hydraulic machines is warmed up by throttling loss caused when the oil flows through pipes, various valves, etc. In other words, the temperature of cooling water for the prime mover does not directly correspond to the temperature of hydraulic oil. Therefore, information given only by lighting-up or turning-out of the warm-up lamp is not enough for the operator to judge whether the front control can be performed, and for eliminating the problem stated above.

An object of the present invention is to provide a front control system for a construction machine and an oil temperature indicator for the front control system, with which front control can be performed accurately and safely even when the temperature of hydraulic oil is low.

(1) To achieve the above object, the present invention provides a front control system equipped on a construction machine comprising a multi-articulated front device made up of a plurality of front members rotatable in the vertical direction, a plurality of hydraulic actuators for driving respectively the plurality of front members, and a plurality of hydraulic control valves driven in accordance with respective signals input from a plurality of operating means for controlling flow rates of hydraulic oil supplied to the plurality of hydraulic actuators, the front control system controlling the front device to be moved in a preset area, wherein the front control system comprises oil temperature detecting means for detecting a temperature of the hydraulic oil, and alarm means for determining in which one of at least three oil temperature ranges including a first oil temperature range, a second oil temperature range higher than the first oil temperature range, and a third oil temperature range higher than the second oil temperature range, the temperature of the hydraulic oil detected by the oil temperature detecting means falls, and issuing an alarm in different ways between the first oil temperature range and the second oil temperature range when the temperature of the hydraulic oil is in the first and second oil temperature ranges.

With this feature, the operator can proceed work while recognizing whether the oil temperature that is an important factor in operation of construction machines is low or not, and at which level in the lower ranges the oil temperature falls currently. More specifically, when the oil temperature is in the second oil temperature range (somewhat low), the operator is prompted by the alarm so as to operate the construction machine carefully in consideration of a reduction in response, and can perform the work under the improved front control. When the oil temperature is in the first oil temperature range (fairly low), the operator is prompted by the alarm so as to perform the work in an manner usually achieved with operation of the operating means without utilizing the front control, because the front control is not suitable at such a low temperature level. Consequently, the front control can be performed accurately and safely even when the temperature of the hydraulic oil is low.

(2) In the above (1), preferably, the alarm means includes alarm indicating means enabling an operator to visually recognize the alarm, and the alarm is issued by actuating the alarm indicating means.

With this feature, the operator can recognize whether the oil temperature is low or not, and at which level in the lower ranges the oil temperature falls currently.

(3) In the above (1), preferably, the alarm means issues the alarm continuously when the temperature of the hydraulic oil is in the first oil temperature range, and issues the alarm intermittently when the temperature of the hydraulic oil is in the second oil temperature range.

With this feature, when the oil temperature is low, the operator can discern whether the oil temperature is in the first or second oil temperature range.

(4) In the above (3), preferably, the alarm means issues the alarm at intervals reducing as the temperature of the hydraulic oil lowers, when the temperature of the hydraulic oil is in the second oil temperature range.

With this feature, when the oil temperature is in the second oil temperature range representing a somewhat low level, the operator is able to know at which level in the second oil temperature range the oil temperature falls currently.

(5) In the above (1), preferably, the alarm means issues the alarm and at the same time forcibly suspends the control of the front device when the temperature of the hydraulic oil is in the first oil temperature range.

With this feature, when the oil temperature is fairly low, the control process is forcibly prevented from entering the front control. Therefore, the front control is prevented from being performed erroneously nonetheless that the oil temperature is fairly low.

(6) In the above (1), the plurality of operating means are of hydraulic pilot type supplying pilot pressures generated depending on input amounts from the operating means to the plurality of hydraulic control valves through respective pilot lines for driving the corresponding hydraulic control valves, and the oil temperature detecting means is disposed in one of the pilot lines of the hydraulic control valves taking part in the control of the front device for detecting a temperature of the hydraulic oil in the one pilot line.

With this feature, since the operator can obtain information about the oil temperature in the pilot line in which the oil temperature is hard to rise and which directly takes part in the front control, it is possible to perform the front control accurately and safely based on the information.

(7) Also, to achieve the above object, the present invention provides an oil temperature indicator in a front control system for a construction machine including a multi-articulated front device made up of a plurality of front members rotatable in the vertical direction, the front control system controlling the front device to be moved in a preset area, wherein the oil temperature indicator comprises oil temperature detecting means for detecting a temperature of the hydraulic oil, alarm indicating means, and alarm control means for determining in which one of at least three oil temperature ranges including a first oil temperature range, a second oil temperature range higher than the first oil temperature range, and a third oil temperature range higher than the second oil temperature range, the temperature of the hydraulic oil detected by the oil temperature detecting means falls, and actuating the alarm indicating means to issue an alarm in different ways between the first oil temperature range and the second oil temperature range when the temperature of the hydraulic oil is in the first and second oil temperature ranges.

With this feature, similarly to the above (1), the front control can be performed accurately and safely.

(8) Further, to achieve the above object, the present invention provides an oil temperature indicator in a front control system for a construction machine including a multi-articulated front device made up of a plurality of front members rotatable in the vertical direction, the front control system controlling the front device to be moved in a preset area, wherein the oil temperature indicator comprises oil temperature detecting means for detecting a temperature of the hydraulic oil, alarm control means for receiving a signal from the oil temperature detecting means and processing the signal through predetermined calculation steps, and alarm indicating means actuated in response to a signal from the alarm control means, and issuing an alarm in different ways between a first oil temperature range and a second oil temperature range in at least three oil temperature ranges including the first oil temperature range, the second oil temperature range higher than the first oil temperature range, and a third oil temperature range higher than the second oil temperature range, when the temperature of the hydraulic oil is in the first and second oil temperature ranges.

With this feature, similarly to the above (1), the front control can be performed accurately and safely.

(9) In the above (7) or (8), preferably, the alarm indicating means includes an alarm lamp disposed on a boxtype control panel installed in a cab.

With this feature, the operator is able to know a condition of the oil temperature while sitting on an operator's seat. This is advantageous for the operator to perform the front control accurately and safely.

DESCRIPTION OF THE PREFERRED EMBODIMENT

Several embodiments of the present invention in which the invention is applied to an area limiting excavation control system for a hydraulic excavator will be described hereunder with reference to FIGS. 1 to 10.

Figure 1:
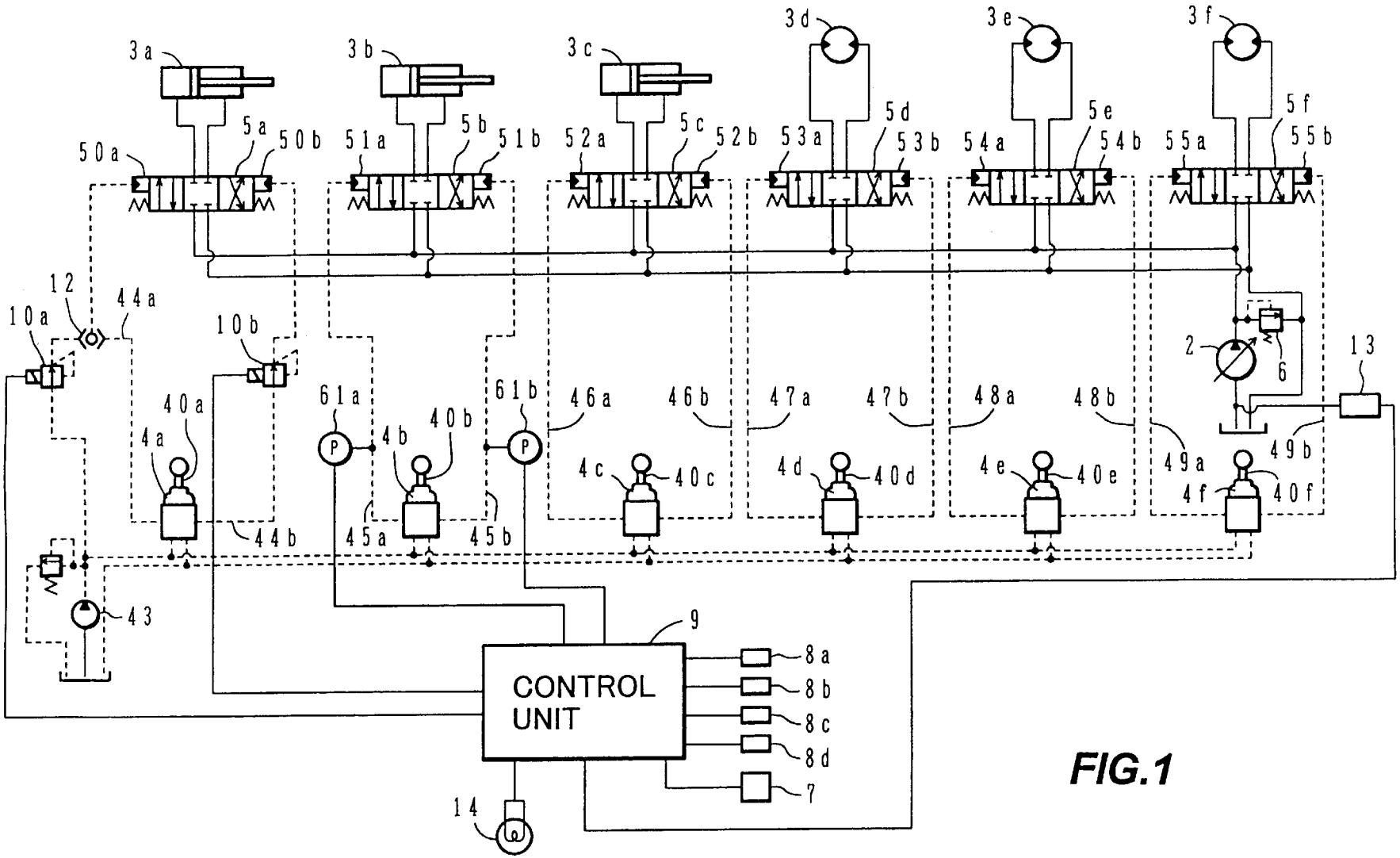
FIG. 1 is a diagram showing a front control system for a construction machine according to a first embodiment of the present invention, along with a hydraulic drive system thereof.

In FIG. 1, a hydraulic excavator to which the present invention is applied comprises a hydraulic pump 2, a plurality of hydraulic actuators driven by a hydraulic fluid (oil) from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 4*a*–4*f* provided respectively associated with the hydraulic actuators 3*a*–3*f*, a plurality of flow control valves 5*a*–5*f* connected between the hydraulic pump 2 and the plurality of hydraulic actuators 3*a*–3*f* and controlled in accordance with respective operation signals input from the control lever units 4*a*–4*f* for controlling respective flow rates of the hydraulic fluid supplied to the hydraulic actuators 3*a*–3*f*, and a relief valve 6 which is opened when the pressure between the hydraulic pump 2 and the flow control valves 5*a*–5*f* exceeds a preset value. The above components cooperatively make up a hydraulic drive system for driving driven members of the hydraulic excavator.

Figure 2:
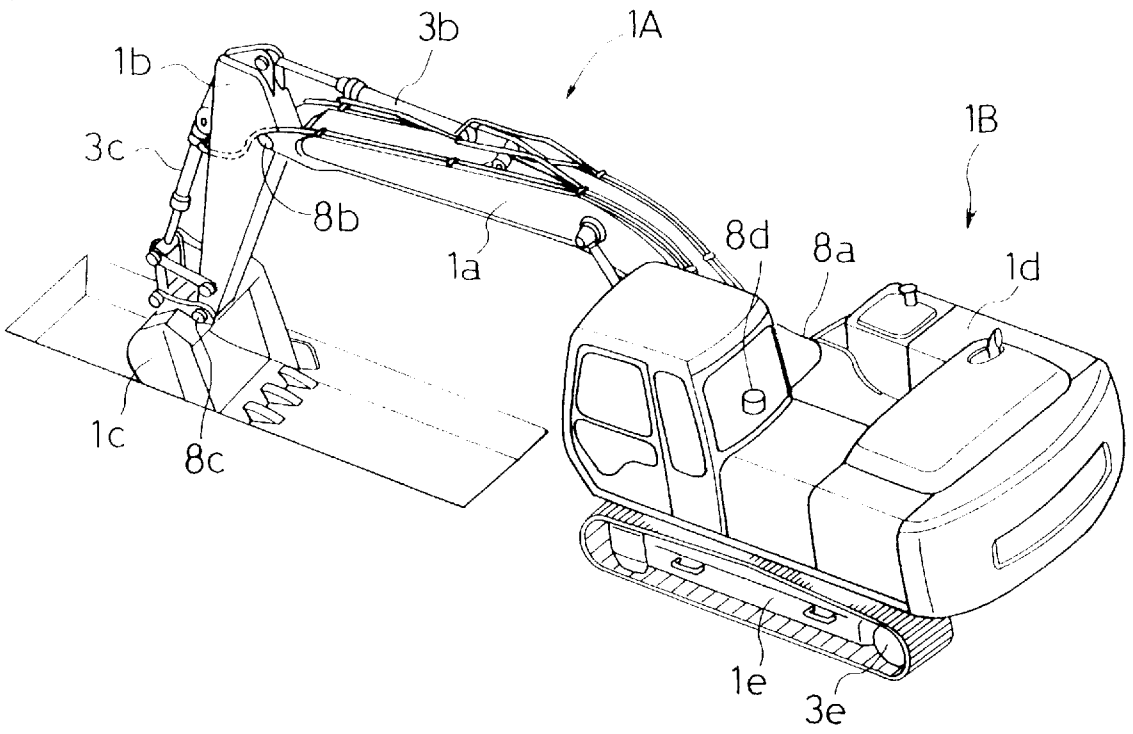
FIG. 2 is a view showing an appearance of a hydraulic excavator to which the present invention is applied.

As shown in FIG. 2, the hydraulic excavator is made up of a multi-articulated front device 1A comprising a boom 1*a*, an arm 1*b* and a bucket 1*c* which are each rotatable in the vertical direction, and a body 1B comprising an upper structure 1*d* and an undercarriage 1*e*. The boom 1*a* of the front device 1A is supported at its base end to a front portion of the upper structure 1*d*. The boom 1*a*, the arm 1*b*, the bucket 1*c*, the upper structure 1*d* and the undercarriage 1*e* serve as driven members which are driven respectively by the boom cylinder 3*a*, the arm cylinder 3*b*, the bucket cylinder 3*c*, the swing motor 3*d* and the left and right track motors 3*e*, 3*f*. These driven members are operated in accordance with instructions from the control lever units 4*a* –4*f*.

Further, the control lever units 4*a*–4*f* are of hydraulic pilot type each generating a pilot pressure depending on the input amount and the direction by and in which the control levers 40*a*–40*f* are each manipulated by the operator, and supplying the pilot pressure to corresponding one of hydraulic driving sectors 50*a*–55*b* of the flow control valves 5*a*–5*f* through pilot lines 44*a*–49*b*, thereby driving these flow control valves.

An area limiting excavation control system of this embodiment is equipped on the hydraulic excavator constructed as explained above. The control system comprises a setting device 7 for providing an instruction to set an excavation area where a predetermined part of the front device, e.g., an end of the bucket 1*c*, is allowed to move for excavation, depending on the scheduled work beforehand, angle sensors 8*a*, 8*b*, 8*c* disposed respectively at pivot points of the boom 1*a*, the arm 1*b* and the bucket 1*c* for detecting respective rotational angles thereof as status variables in relation to the position and posture of the front device 1A, a tilt angle sensor 8*d* for detecting a tilt angle of the body 1B in the back-and-forth direction, an oil temperature sensor 13 for detecting a temperature of the hydraulic oil and outputting a signal corresponding to the detected temperature, pressure sensors 61*a*, 61*b* disposed in the pilot lines 45*a*, 45*b* of the arm control lever unit 4*b* for detecting respective pilot pressures representative of the input amount by which the control lever unit 4*b* is operated, an alarm lamp 14, a proportional solenoid valve lOa connected at its primary port side to a pilot pump 43 for reducing a pilot pressure from the pilot pump 43 in accordance with an electric signal applied thereto and outputting the reduced pilot pressure, a shuttle valve 12 connected to the pilot line 44*a* of the boom control lever unit 4*a* and the secondary port side of the proportional solenoid valve 10*a* for selecting higher one of the pilot pressure in the pilot line 44*a* and the control pressure delivered from the proportional solenoid valve 10*a* and introducing the selected pressure to the hydraulic driving sector 50*a* of the flow control valve 5*a*, a proportional solenoid valve 10*b* disposed in the pilot line 44*b* of the boom control lever unit 4*a* for reducing the pilot pressure in the pilot line 44*b* in accordance with an electric signal applied thereto and outputting the reduced pilot pressure, and a control unit 9 for receiving a setup signal from the setting device 7 and detection signals from the angle sensors 8*a*, 8*b*, 8*c*, the tilt angle sensor 8*d*, the oil temperature sensor 13 and the pressure sensors 61*a*, 61*b*, setting the excavation area where the end of the bucket 1*c* is allowed to move, outputting to the proportional solenoid valves 10*a*, 10*b* electric signals for modifying the operation signals to carry out control for excavation within a limited area, and lighting up the alarm lamp 14 to issue an alarm when the temperature of the hydraulic oil is lowered.

The setting device 7 has manipulation means, such as a switch, disposed on a control panel or grip for outputting a setup signal to the control unit 9 to instruct setting of the excavation area. Other suitable aid means such as a display may be provided on the control panel. As an alternative, the setting of the excavation area may be instructed by any of other suitable methods such as using IC cards, bar codes, lasers, and wireless communication.

The oil temperature sensor 13 may be connected to anywhere so long as the temperature of the hydraulic oil can be detected. In this embodiment, the sensor 13 is connected to, by way of example, a line on the input side of the hydraulic pump 2.

Figure 3:
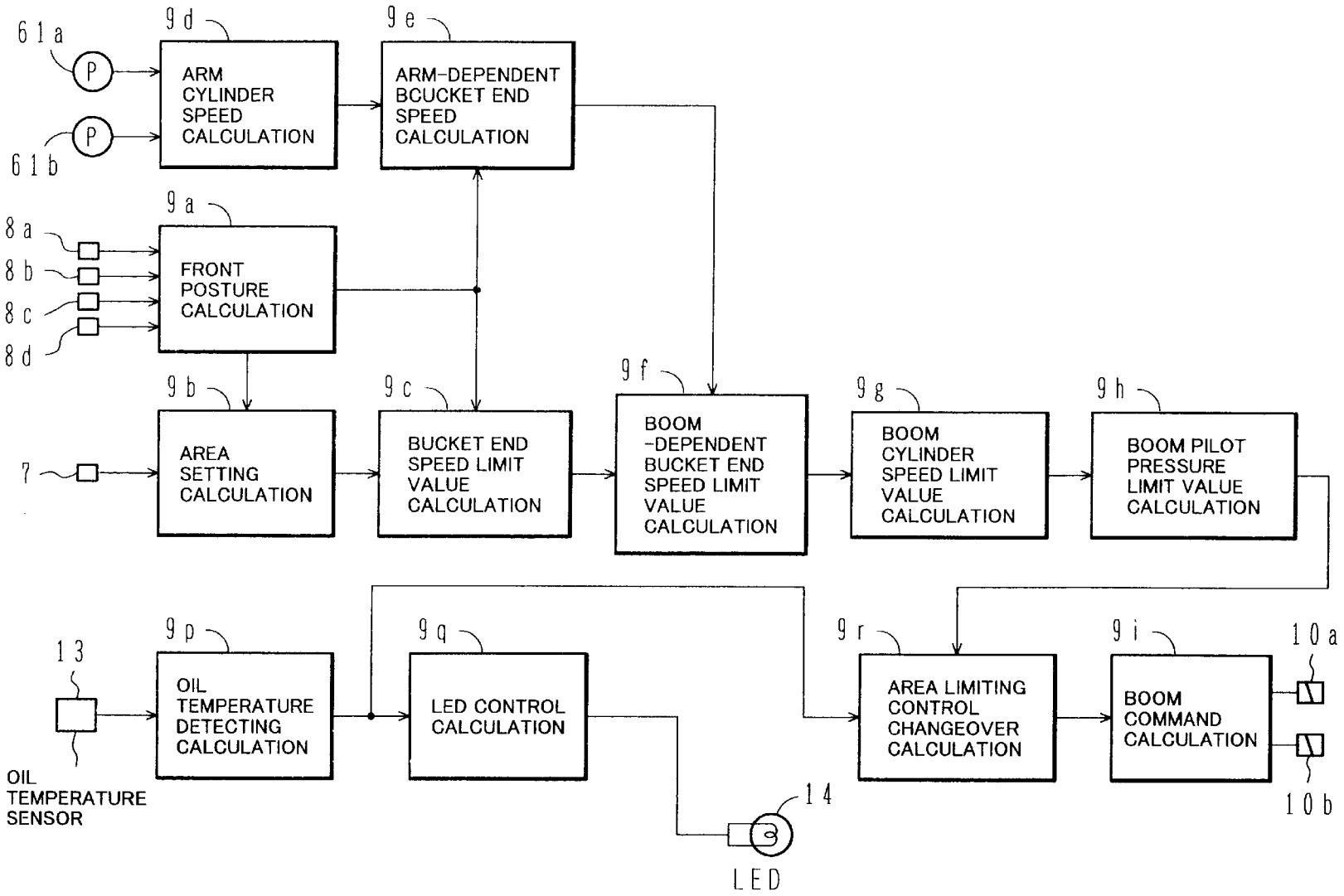
FIG. 3 is a functional block diagram showing control functions of a control unit.

FIG. 3 shows control functions of the control unit 9. The control unit 9 has various functions executed by a front posture calculating portion 9*a*, an area setting calculating portion 9*b*, a bucket end speed limit value calculating portion 9*c*, an arm cylinder speed calculating portion 9*d*, an arm-dependent bucket end speed calculating portion 9*e*, a boom-dependent bucket end speed limit value calculating portion 9*f*, a boom cylinder speed limit value calculating portion 9*g*, a boom pilot pressure limit value calculating portion 9*h*, an oil temperature detecting/-calculating portion 9*p*, an LED control calculating portion 9*q*, an area limiting control changeover calculating portion 9*r*, and a boom command calculating portion 9*i*.

The front posture calculating portion 9*a* calculates the position and posture of the front device 1A based on the respective rotational angles of the boom, the arm and the bucket detected by the angle sensors 8*a*–8*c*, as well as the tilt angle of the body 1B in the back-and-forth direction detected by the tilt angle sensor 8*d*.

The area setting calculating portion 9*b* executes calculation for setting of the excavation area where the end of the bucket 1*c* is allowed to move, in accordance with an instruction from the setting device 7. The setting calculation may be performed by any one of direct teaching and numeral inputting. One example of a manner of setting the excavation area by direct teaching will be described with reference to FIG. 4.

Figure 4:
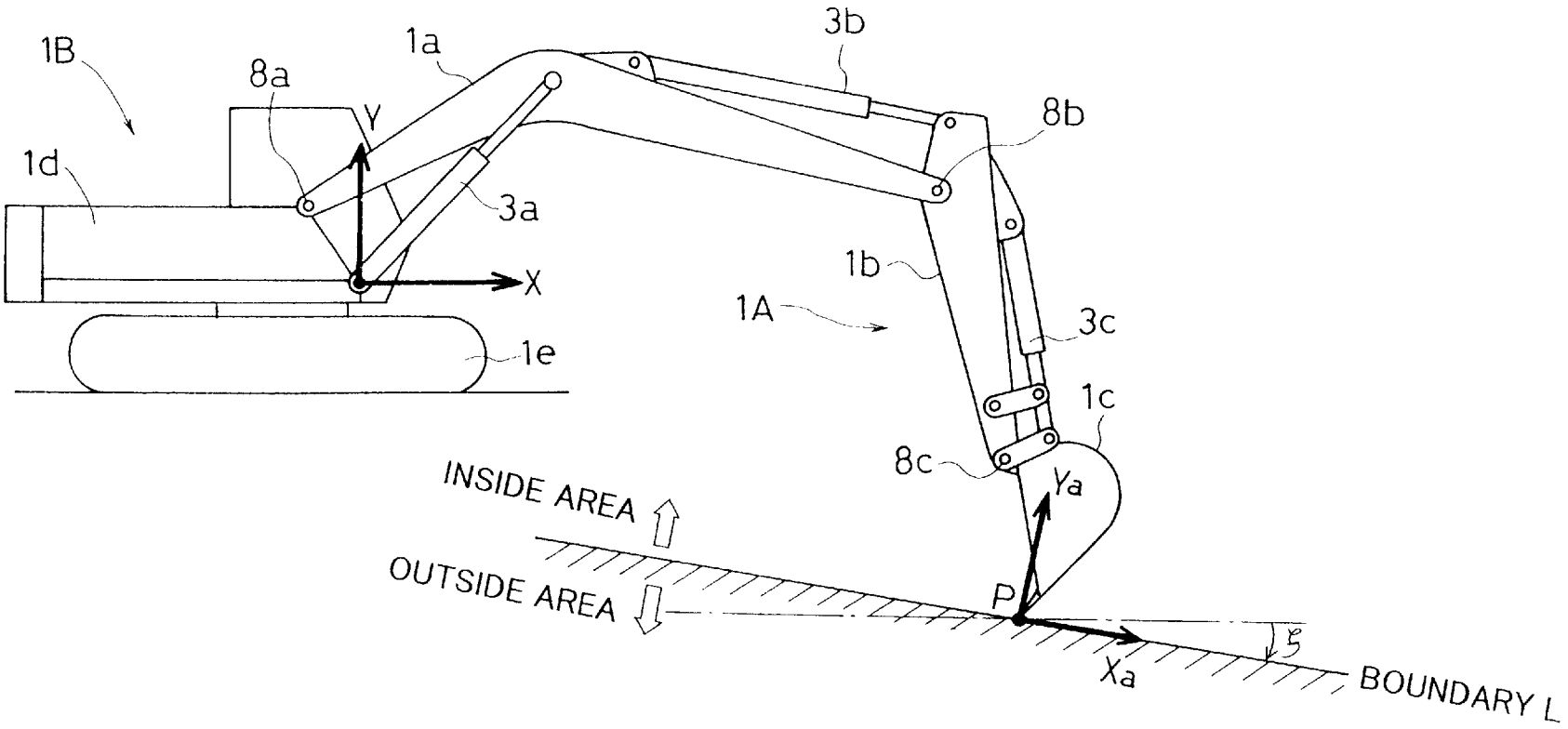
FIG. 4 is a side view for explaining a manner of setting an excavation area for use in area limiting excavation control according to the first embodiment.

In FIG. 4, after the end of the bucket 1*c* has been moved to the position of a point P by the operator manipulating the front device, the end position of the bucket 1*c* at that time is calculated in response to an instruction from the setting device 7. Then, a boundary L of the limited excavation area is set based on a tilt angle ξ instructed from the setting device 7.

Here, the control unit 9 stores various dimensions of the front device 1A and the body 1B in its memory, and the area setting calculating portion 9*b* calculates the position of the point P, in cooperation with the front posture calculating portion 9*a*, based on the stored data, the rotational angles detected by the angle sensors 8*a*, 8*b*, 8*c*, and the tilt angle of the body 1B detected by the tilt angle sensor 8*d*. At this time, the position of the point P is determined as coordinate values on an XY-coordinate system with the origin defined by, for example, the pivot point of the boom 1*a*. The XY-coordinate system is a rectangular coordinate system fixed on the body 1B and lying in a vertical plane.

Then, the area setting calculating portion 9*b* derives a formula of a straight line expressing the boundary L of the limited excavation area based on the position of the point P and the tilt angle ξ instructed from the setting device 7, and establishes an XaYa-coordinate system having the origin located on that straight line and one axis defined by that straight line, e.g., an XaYa-coordinate system with the origin defined by the point P. Further, the calculating portion 9*b* determines transform data from the XY-coordinate system to the XaYa-coordinate system.

The bucket end speed limit value calculating portion 9*c* calculates a limit value a of the component of the bucket end speed vertical to the boundary L of the set area depending on a distance D to the bucket end from the boundary L. This calculation is carried out by storing the relationship as shown in FIG. 5 in the memory of the control unit 9 beforehand and reading out the stored relationship.

Figure 5:
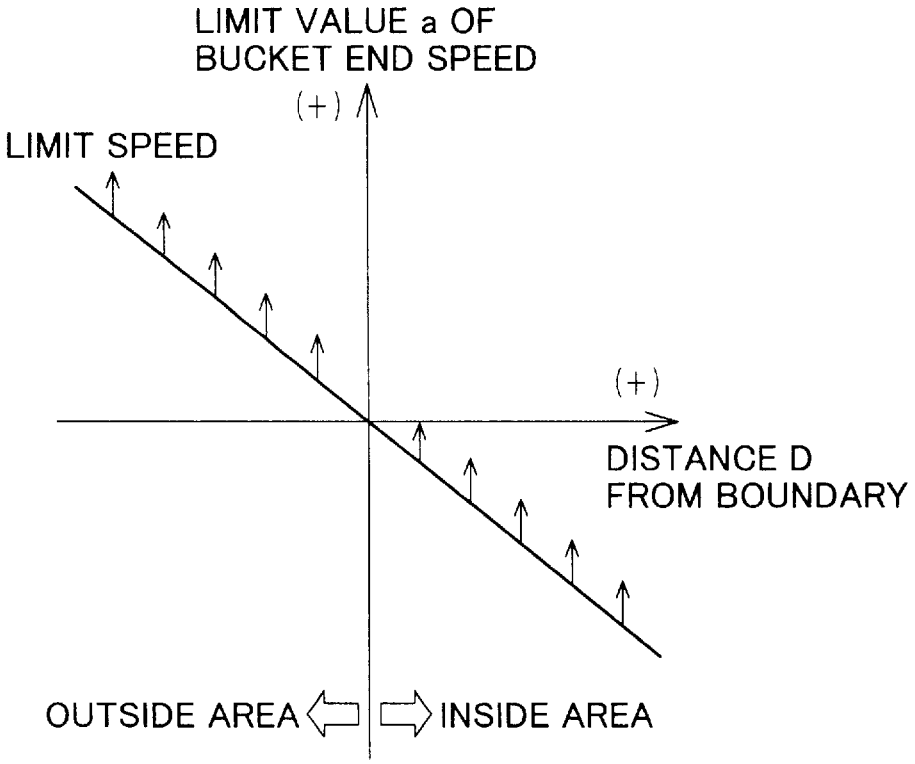
FIG. 5 is a graph showing the relationship between a distance to a bucket end from a boundary of the set area and a bucket end speed limit value, the relationship being used when the limit value is determined.

In FIG. 5, the horizontal axis represents the distance D to the bucket end from the boundary L of the set area, and the vertical axis represents the limit value a of the component of the bucket end speed vertical to the boundary L. As with the XaYa-coordinate system, the distance D on the horizontal axis and the speed limit value a on the vertical axis are each defined to be positive (+) in the direction toward the inside of the set area from the outside of the set area. The relationship between the distance D and the limit value a is set such that when the bucket end is inside the set area, a speed in the negative (−) direction proportional to the distance D is given as the limit value a of the component of the bucket end speed vertical to the boundary L, and when the bucket end is outside the set area, a speed in the positive (+) direction proportional to the distance D is given as the limit value a of the component of the bucket end speed vertical to the boundary L. Accordingly, inside the set area, the bucket end is slowed down only when the component of the bucket end speed vertical to the boundary L exceeds the limit value in the negative (−) direction, and outside the set area, the bucket end is sped up in the positive (+) direction.

Note that while the relationship between the distance D to the bucket end from the boundary L of the set area and the limit value a of the bucket end speed is explained above as being linearly proportional, the relationship is not limited to the above example, but may be set in any of other various suitable ways.

The arm cylinder speed calculating portion 9*d* estimates an arm cylinder speed based on a command value (pilot pressure) applied to the flow control valve 5*b* for the arm, which is detected by the pressure sensor 61*a*, 61*b*, and the flow rate characteristic of the flow control valve 5*b*.

The arm-dependent bucket end speed calculating portion 9*e* calculates an arm-dependent bucket end speed b based on the arm cylinder speed and the position and posture of the front device 1A determined in the front posture calculating portion 9*a*.

The boom-dependent bucket end speed limit value calculating portion 9*f* transforms the arm-dependent bucket end speed b, which has been determined in the calculating portion 9*e*, from the XY-coordinate system to the XaYa-coordinate system by using the transform data determined in the area setting calculating portion 9*b*, calculates arm-dependent bucket end speeds ($b_x$, $b_y$), and then calculates a limit value c of the component of the boom-dependent bucket end speed vertical to the boundary L based on the limit value a of the component of the bucket end speed vertical to the boundary L determined in the calculating portion 9*c* and the component $b_y$ of the arm-dependent bucket end speed vertical to the boundary L. Such a process will now be described with reference to FIG. 6.

Figure 6:
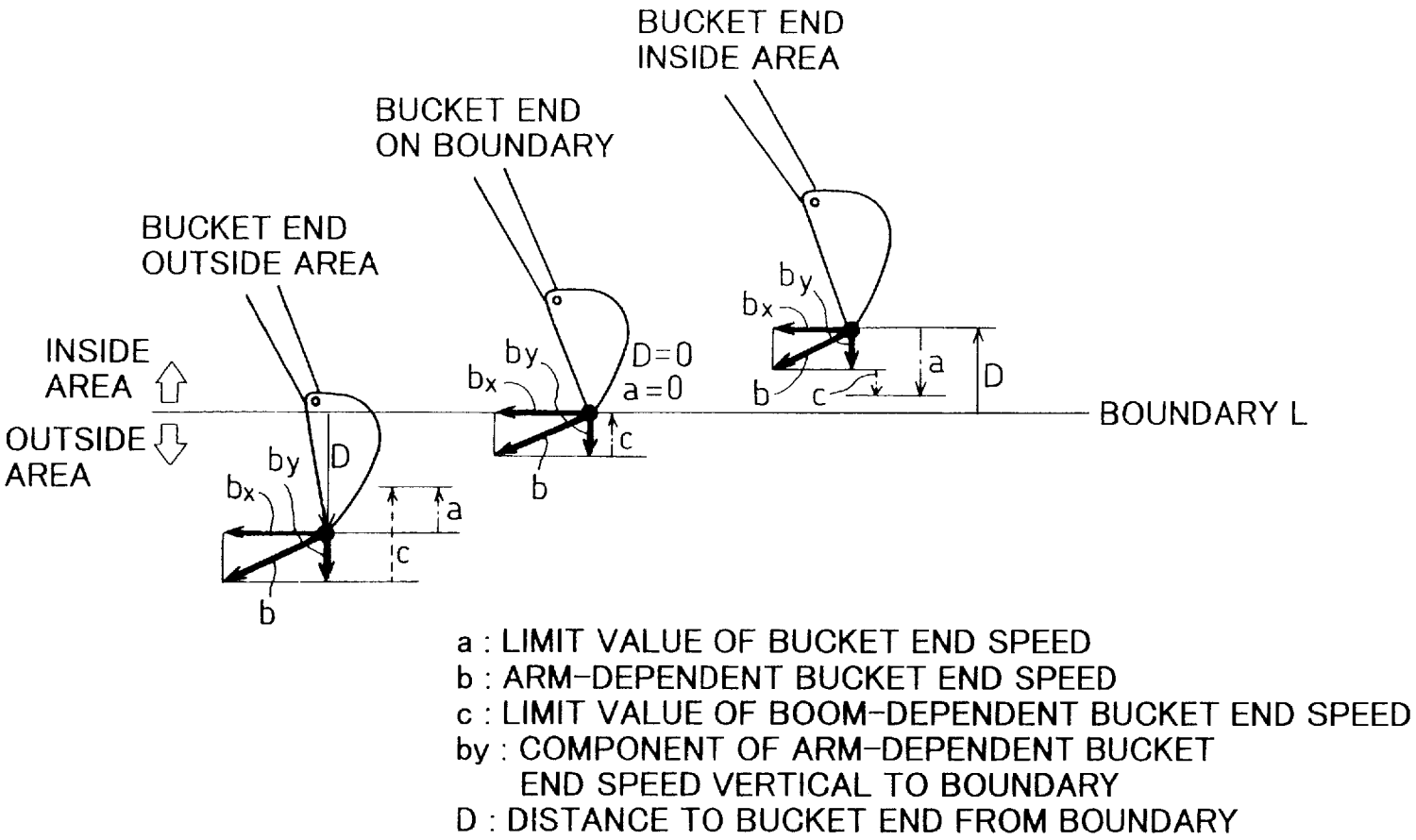
FIG. 6 is an illustrative view showing differences in operation of modifying a boom-dependent bucket end speed among the case of a bucket end positioned inside the set area, the case of the bucket end positioned on the boundary of the set area, and the case of the bucket end positioned outside the set area.

In FIG. 6, the difference ($a-b_y$) between the limit value a of the component of the bucket end speed vertical to the boundary L determined in the bucket end speed limit value calculating portion 9*c* and the component $b_y$ of the arm-dependent bucket end speed b vertical to the boundary L determined in the arm-dependent bucket end speed calculating portion 9*e* provides a limit value c of the boom-dependent bucket end speed vertical to the boundary L. Then, the boom-dependent bucket end speed limit value calculating portion 9*f* calculates the limit value c from the formula of $c=a-b_y$.

The meaning of the limit value c will be described separately for the case where the bucket end is inside the set area, the case where the bucket end is on the boundary of the set area, and the case where the bucket end is outside the set area.

When the bucket end is inside the set area, the bucket end speed is restricted to the limit value a of the component of the bucket end speed vertical to the boundary L in proportion to the distance D to the bucket end from the boundary L and, therefore, the component of the boom-dependent bucket end speed vertical to the boundary L is restricted to c ($=a-b_y$). Thus, if the component $b_y$ of the bucket end speed b vertical to the boundary L exceeds c, the boom is slowed down to c.

When the bucket end is on the boundary L of the set area, the limit value a of the component of the bucket end speed vertical to the boundary L is set to 0, and the arm-dependent bucket end speed b toward the outside of the set area is cancelled out through the compensating operation of boom-up at the speed c. Thus, the component $b_y$ of the bucket end speed vertical to the boundary L becomes 0.

When the bucket end is outside the set area, the component of the bucket end speed vertical to the boundary L is restricted to the upward speed a in proportion to the distance D to the bucket end from the boundary L. Thus, the compensating operation of boom-up at the speed c is always performed so that the bucket end is restored to the inside of the set area.

The boom cylinder speed limit value calculating portion 9*g* calculates a limit value of the boom cylinder speed through the coordinate transformation using the aforesaid transform data based on the limit value c of the component of the boom-dependent bucket end speed vertical to the boundary L and the position and posture of the front device 1A.

The boom pilot pressure limit value calculating portion 9*h* determines, based on the flow rate characteristic of the flow control valve 5*a* for the boom, a limit value of the boom pilot pressure corresponding to the limit value of the boom cylinder speed determined in the calculating portion 9*g*.

Figure 7:
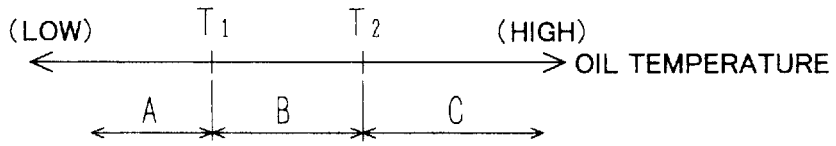
FIG. 7 is an illustrative view for explaining the concept based on which an oil temperature detecting/calculating portion divides a range of oil temperature into three oil temperature ranges.

The oil temperature detecting/calculating portion 9*p* transforms a signal from the oil temperature sensor 13 into an oil temperature based on a table set beforehand. Also, as shown in FIG. 7, threshold values $T_1$, $T_2$ are set in the calculating portion 9*p* beforehand to divide a range of oil temperature into a first oil temperature range A representing the lowest level, a second oil temperature range B representing a relatively low level, and a third oil temperature range C representing a normal level. The calculating portion 9*p* executes an alarm control process by comparing the detected oil temperature with the threshold values $T_1$, $T_2$.

Figure 8:
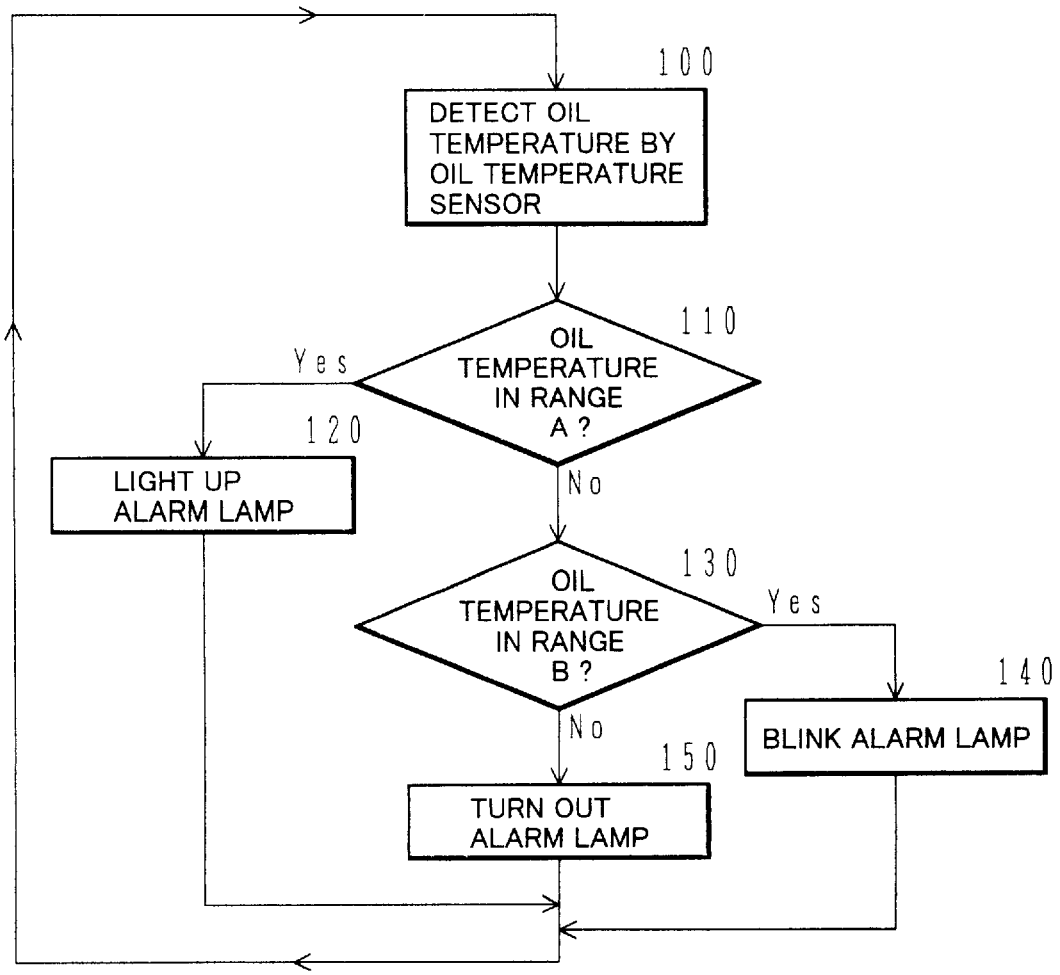
FIG. 8 is a flowchart showing processing steps executed in the oil temperature detecting/calculating portion.

Details of the alarm control process are shown in a flowchart of FIG. 8. Referring to FIG. 8, when the detected oil temperature is in the first oil temperature range A, the process is executed to make the alarm lamp 14 light up continuously (steps 100→110→120). When the detected oil temperature is in the second oil temperature range B, the process is executed to make the alarm lamp 14 blink (steps 100→110→130→140). When the detected oil temperature is in the third oil temperature range C, the process is executed to make the alarm lamp 14 turn out (steps 100→110→130→150).

In accordance with the process result of the oil temperature detecting/calculating portion 9*p*, the LED control calculating portion 9*q* lights up the alarm lamp 14 continuously when the detected oil temperature is in the first oil temperature range A, thereby informing the operator of that the oil temperature is fairly low. When the detected oil temperature is in the second oil temperature range B, the calculating portion 9*q* blinks the alarm lamp 14, thereby informing the operator of that the oil temperature is somewhat low. When the detected oil temperature is in the third oil temperature range C, the calculating portion 9*q* turns out the alarm lamp 14, thereby informing the operator of that the oil temperature is at a normal level.

In addition, when the detected oil temperature is in the second oil temperature range B, the calculating portion 9*q* further executes a process of changing the interval at which the alarm lamp 14 blinks within the second oil temperature range B. Assuming that the detected value of the oil temperature is T ($T_1<T<T_2$), the blinking interval at the oil temperature near the first oil temperature range A is $t_1$, the blinking interval at the oil temperature near the third oil temperature range C is $t_2$, and the target blinking interval is t, the calculating portion 9*q* determines t from the following formula:

$$t=((T-T_1)/(T_2-T_1))(t_2-t_1)+t_1$$

With the above process, the operator can estimate whether the oil temperature is near the higher or lower side in the second oil temperature range B, by judging from the interval at which the alarm lamp 14 is blinking.

The area limiting control changeover calculating portion 9*r* outputs, as the limit value of the boom pilot pressure, its maximum value when the detected oil temperature is in the first oil temperature range A, and the value calculated in the calculating portion 9*h* as it is when the detected oil temperature is in the second oil temperature range B and the third oil temperature range C. Here, setting the limit value of the boom pilot pressure to the maximum value means that the area limiting excavation control is suspended.

The boom command calculating portion 9*i* receives the limit value of the pilot pressure from the calculating portion 9*r* and when the received limit value is positive, it outputs a voltage corresponding to the limit value to the proportional solenoid valve 10*a* on the boom-up side, thereby restricting the pilot pressure imposed on the hydraulic driving sector 50*a* of the flow control valve 5*a* to that limit value, and outputs a voltage of 0 to the proportional solenoid valve 10*b* on the boom-down side, thereby making nil (0) the pilot pressure imposed on the hydraulic driving sector 50*b* of the flow control valve 5*a*. When the received limit value is negative, the boom command calculating portion 9*i* outputs a voltage corresponding to the limit -value to the proportional solenoid valve 10*b* on the boom-down side, thereby restricting the pilot pressure imposed on the hydraulic driving sector 50*b* of the flow control valve 5*a* to that limit value, and outputs a voltage of 0 to the proportional solenoid valve 10*a* on the boom-up side, thereby making nil (0) the pilot pressure imposed on the hydraulic driving sector 50*a* of the flow control valve 5*a*.

In the above arrangement, the oil temperature sensor 13, the oil temperature detecting/calculating portion 9*p* and the LED control calculating portion 9*q* of the control unit 9, and the alarm lamp 14 jointly constitute an oil temperature indicator with which front control can be accurately and safely performed even when the temperature of the hydraulic oil is low.

The operation of this embodiment having the above-explained arrangement will be described below in connection with several work examples; i,e., the case of operating the control lever of the boom control lever unit 4*a* in the boom-down direction to lower the boom with the intention of positioning the bucket end (i.e., the boom-down operation), and the case of operating the control lever of the arm control lever unit 4*b* in the arm-crowding direction to crowd the arm with the intention of digging the ground toward the body (i.e., the arm crowding operation).

When the control lever of the boom control lever unit 4*a* is operated in the boom-down direction with the intention of positioning the bucket end, a pilot pressure representative of the command value from the control lever unit 4*a* is applied to the hydraulic driving sector 50*b* of the flow control valve 5*a* on the boom-down side through the pilot line 44*b*. At the same time, the bucket end speed limit value calculating portion 9*c* calculates, based on the relationship shown in FIG. 5, a limit value a (<0) of the bucket end speed in proportion to the distance D to the bucket end from the boundary L of the set area, the boom-dependent bucket end speed limit value calculating portion 9*f* calculates a limit value c=a (<0) of the boom-dependent bucket end speed, and the boom pilot pressure limit value calculating portion 9*h* calculates a negative limit value of the boom pilot pressure corresponding to the limit value c. Then, the boom command calculating portion 9*i* outputs a voltage corresponding to the calculated limit value to the proportional solenoid valve 10*b*, thereby restricting the pilot pressure applied to the hydraulic driving sector 50*b* of the flow control valve 5*a* on the boom-down side, and also outputs a voltage of 0 to the proportional solenoid valve 10*a* for making nil (0) the pilot pressure applied to the hydraulic driving sector 50*a* of the flow control valve 5*a* on the boom-up side. Here, when the bucket end is far away from the boundary L of the set area, the limit value of the boom pilot pressure determined in the calculating portion 9*h* has an absolute value greater than that of the pilot pressure from the control lever unit 4*a*, and therefore the proportional solenoid valve 10*b* outputs the pilot pressure from the control lever unit 4*a* as it is. Accordingly, the boom is gradually moved down depending on the pilot pressure from the control lever unit 4*a*.

As the boom is gradually moved down and the bucket end comes closer to the boundary L of the set area as mentioned above, the limit value c=a (<0) of the boom-dependent bucket end speed calculated in the calculating portion 9*f* is increased (its absolute value |a| or |c| is reduced) and an absolute value of the corresponding boom command limit value (<0) calculated in the calculating portion 9*h* is reduced. Then, when the absolute value of the limit value becomes smaller than the command value from the control lever unit 4*a* and the voltage output to the proportional solenoid valve 10*b* from the boom command calculating portion 9*i* is reduced correspondingly, the proportional solenoid valve 10*b* reduces and then outputs the pilot pressure from the control lever unit 4*a* for gradually restricting the pilot pressure applied to the hydraulic driving sector 50*b* of the flow control valve 5*a* on the boom-down side depending on the limit value c. Thus, the boom-down speed is gradually restricted as the bucket end comes closer to the boundary L of the set area, and the boom is stopped when the bucket end reaches the boundary L of the set area. As a result, the bucket end can be easily and smoothly positioned.

When the bucket end has moved out beyond the boundary L of the set area, the limit value a (=c) of the bucket end speed in proportion to the distance D to the bucket end from the boundary L of the set area is calculated as a positive value in the calculating portion 9*c* based on the relationship shown in FIG. 5, and the boom command calculating portion 9*i* outputs a voltage corresponding to the limit value c to the proportional solenoid valve 10*a* for applying a pilot pressure corresponding to the limit value a to the hydraulic driving sector 50*a* of the flow control valve 5*a* on the boom-up side. The boom is thereby moved in the boom-up direction at a speed proportional to the distance D for restoration toward the inside of the set area, and then stopped when the bucket end is returned to the boundary L of the set area. As a result, the bucket end can be more smoothly positioned.

Further, when the control lever of the arm control lever unit 4*b* is operated in the arm-crowding direction with the intention of digging the ground toward the body, a pilot pressure representative of the command value from the control lever unit 4*b* is applied to the hydraulic driving sector 51*a* of the flow control valve 5*b* on the arm-crowding side, causing the arm to be moved down toward the body. At the same time, the pilot pressure from the control lever unit 4*b* is detected by the pressure sensor 61*a* and input to the calculating portion 9*d* which calculates an arm cylinder speed. Then, the calculating portion 9*e* calculates an arm-dependent bucket end speed b. On the other hand, the calculating portion 9*c* calculates, based on the relationship shown in FIG. 5, a limit value a (<0) of the bucket end speed in proportion to the distance D to the bucket end from the boundary L of the set area, and the calculating portion 9*f* calculates a limit value $c=a-b_y$ of the boom-dependent bucket end speed. Here, when the bucket end is so far away from the boundary L of the set area as to meet the relationship of $a<b_y$ ($|a|>|b_y|$), the limit value c is calculated as a negative value in the calculating portion 9*f*. Therefore, the boom command calculating portion 9*i* outputs a voltage corresponding to the calculated limit value to the proportional solenoid valve 10*b*, thereby restricting the pilot pressure applied to the hydraulic driving sector 50*b* of the flow control value 5*a* on the boom-down side, and also outputs a voltage of 0 to the proportional solenoid valve 10a for making nil (0) the pilot pressure applied to the hydraulic driving sector 50*a* of the flow control valve 5*a* on the boom-up side. At this time, since the control lever unit 4*a* is not operated, no pilot pressure is applied to the hydraulic driving sector 50*b* of the flow control valve 5*a*. As a result, the arm is gradually moved toward the body depending on the pilot pressure from the control lever unit 4*b*.

Figure 9:
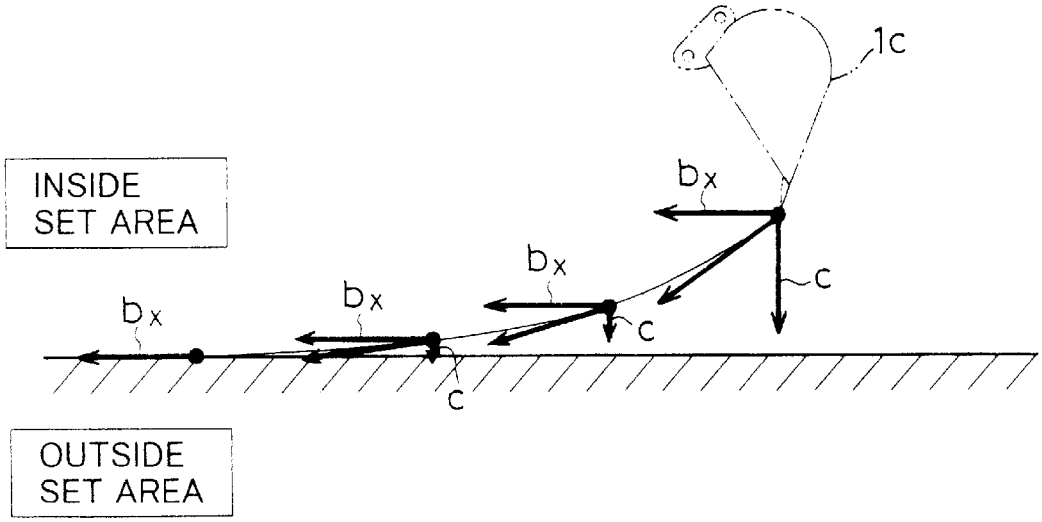
FIG. 9 is an illustrative view showing one example of a locus along which the bucket end is moved under modified operation when it is inside the set area.

As the arm is gradually moved toward the body and the bucket end comes closer to the boundary L of the set area as mentioned above, the limit value a of the bucket end speed calculated in the calculating portion 9*c* is increased (its absolute value |a| is reduced). Then, when the limit value a becomes greater than the component $b_y$ of the arm-dependent bucket end speed b vertical to the boundary L calculated in the calculating portion 9*e*, the limit value $c=a-b_y$ of the boom-dependent bucket end speed is calculated as a positive value in the calculating portion 9*f*. Therefore, the boom command calculating portion 9*i* outputs a voltage corresponding to the limit value c to the proportional solenoid valve 10*a* on the boom-up side, thereby restricting the pilot pressure applied to the hydraulic driving sector 50*a* of the flow control valve 5*a* to that limit value, and also outputs a voltage of 0 to the proportional solenoid valve 10*b* on the boom-down side for making nil (0) the pilot pressure applied to the hydraulic driving sector 50*b* of the flow control valve 5*a*. Accordingly, the boom-up operation for modifying the bucket end speed is performed such that the component of the bucket end speed vertical to the boundary L is gradually restricted in proportion to the distance D to the bucket end from the boundary L. Thus, direction change control is carried out with a resultant of the unmodified component $b_x$ of the arm-dependent bucket end speed parallel to the boundary L and the speed component vertical to the boundary L modified in accordance with the limit value c, as shown in FIG. 9, enabling the excavation to be performed along the boundary L of the set area.

Figure 10:
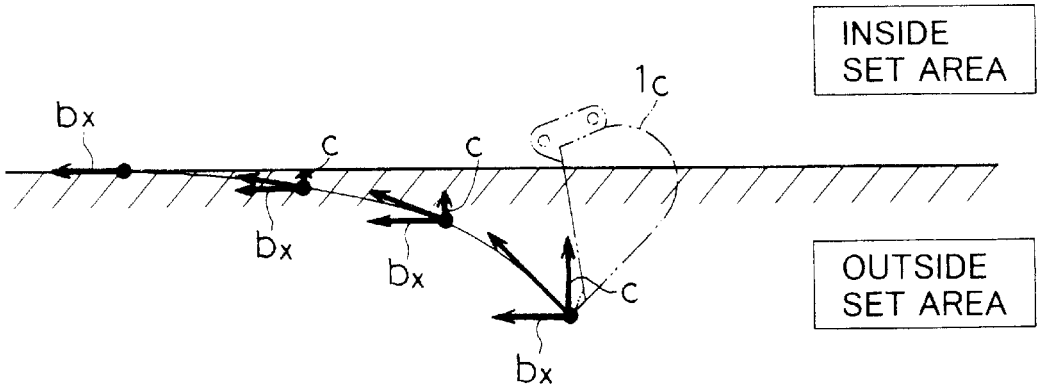
FIG. 10 is an illustrative view showing one example of a locus along which the bucket end is moved under modified operation when it is outside the set area.

When the bucket end has moved out beyond the boundary L of the set area, the limit value a of the bucket end speed in proportion to the distance D to the bucket end from the boundary L of the set area is calculated as a positive value in the calculating portion 9*c* based on the relationship shown in FIG. 5, the limit value $c=a-b_y$ (>0) of the boom-dependent bucket end speed calculated in the calculating portion 9*f* is increased in proportion to the limit value a, and the voltage output from the boom command calculating portion 9*i* to the proportional solenoid valve 10*a* on the boom-up side is increased depending on the limit value c. In the case of the bucket end having moved out of the set area, therefore, the boom-up operation for modifying the bucket end speed is performed so that the bucket end is restored toward the inside of the set area at a speed proportional to the distance D. Thus, the excavation is carried out with a resultant of the unmodified component $b_x$ of the arm-dependent bucket end speed parallel to the boundary L and the speed component vertical to the boundary L modified in accordance with the limit value c, while the bucket end is gradually returned to and moved along the boundary L of the set area as shown in FIG. 10. Consequently, the excavation can be smoothly performed along the boundary L of the set area just by crowding the arm.

The above-stated operation is carried out when the temperature of the hydraulic oil is in the second oil temperature range B and in the third oil temperature range C. Specifically, when the temperature of the hydraulic oil is in the third oil temperature range C, the alarm lamp 14 is not lit up, enabling the operator to recognize that the oil temperature is not low. Then, the operator can perform the boom-down operation and the arm crowding operation under the area limiting excavation control without anxiety. When the temperature of the hydraulic oil is in the second oil temperature range B, the alarm lamp 14 blinks to inform the operator of that the oil temperature is somewhat low. This enables the operator to recognize that a response of the machine is poor because of the relatively low oil temperature, and to proceed the operation carefully in consideration of a poor response of the machine. Therefore, the operator can perform the boom-down operation and the arm crowding operation accurately and safely under the area limiting excavation control. In addition, the different intervals at which the alarm lamp 14 is blinking inform the operator of at which level the oil temperature falls in the second oil temperature range B. Accordingly, it is possible for the operator to know change in the oil temperature and proceed the operation depending on the oil temperature, resulting in increased convenience.

On the other hand, when the temperature of the hydraulic oil is in the first oil temperature range A, the alarm lamp 14 is lit up continuously to inform the operator of that the oil temperature is fairly low. At the same time, the area limiting control changeover calculating portion 9*r* outputs, as the limit value of the boom pilot pressure, its maximum value, thereby forcibly suspending the area limiting excavation control. This surely avoids the area limiting excavation control from being performed erroneously when the oil temperature is fairly low, and prevents the bucket end from moving out beyond the boundary of the set area and entering the forbidden area due to a response delay of the hydraulic equipments.

With this embodiment, as described above, when the bucket end is inside the set area, the component of the bucket end speed vertical to the boundary L of the set area is restricted in accordance with the limit value a in proportion to the distance D to the bucket end from the boundary L of the set area. Therefore, in the boom-down operation, the bucket end can be easily and smoothly positioned, and in the arm crowding operation, the bucket end can be moved along the boundary L of the set area. This enables the excavation to be efficiently and smoothly performed within a limited area.

When the bucket end is outside the set area, the front device is controlled to return to the set area in accordance with the limit value a in proportion to the distance D to the bucket end from the boundary L of the set area. Therefore, even when the front device is moved quickly, the front device can be moved along the boundary L of the set area and the excavation can be precisely performed within a limited area.

Further, since the bucket end is slowed down under the direction change control before reaching the boundary of the set area as described above, an amount by which the bucket end projects out of the set area is reduced and a shock caused upon the bucket end returning to the set area is greatly alleviated. Therefore, even when the front device is moved quickly, the front device can be smoothly moved back to the set area and the excavation can be smoothly performed within a limited area.

Moreover, in this embodiment, the oil temperature is detected by the oil temperature sensor 13. Then, when the temperature of the hydraulic oil is fairly low, the alarm lamp 14 is lit up continuously, enabling the operator to recognize that the oil temperature is so low, and at the same time the area limiting excavation control is forcibly suspended. It is therefore possible to avoid the area limiting excavation control from being performed erroneously when the oil temperature is fairly low. When the oil temperature is somewhat low, the alarm lamp 14 blinks, enabling the operator to recognize that a response of the machine is poor because of the relatively low oil temperature, and to proceed the operation carefully in consideration of a poor response of the machine. As a result, the operator can perform the excavation work accurately and safely under the area limiting excavation control.

A second embodiment of the present invention will be described with reference to FIG. 11. In this drawing, equivalent members to those in FIG. 1 are denoted by the same reference numerals. In this embodiment, the oil temperature sensor is connected to other position than described in the above embodiment.

Figure 11:
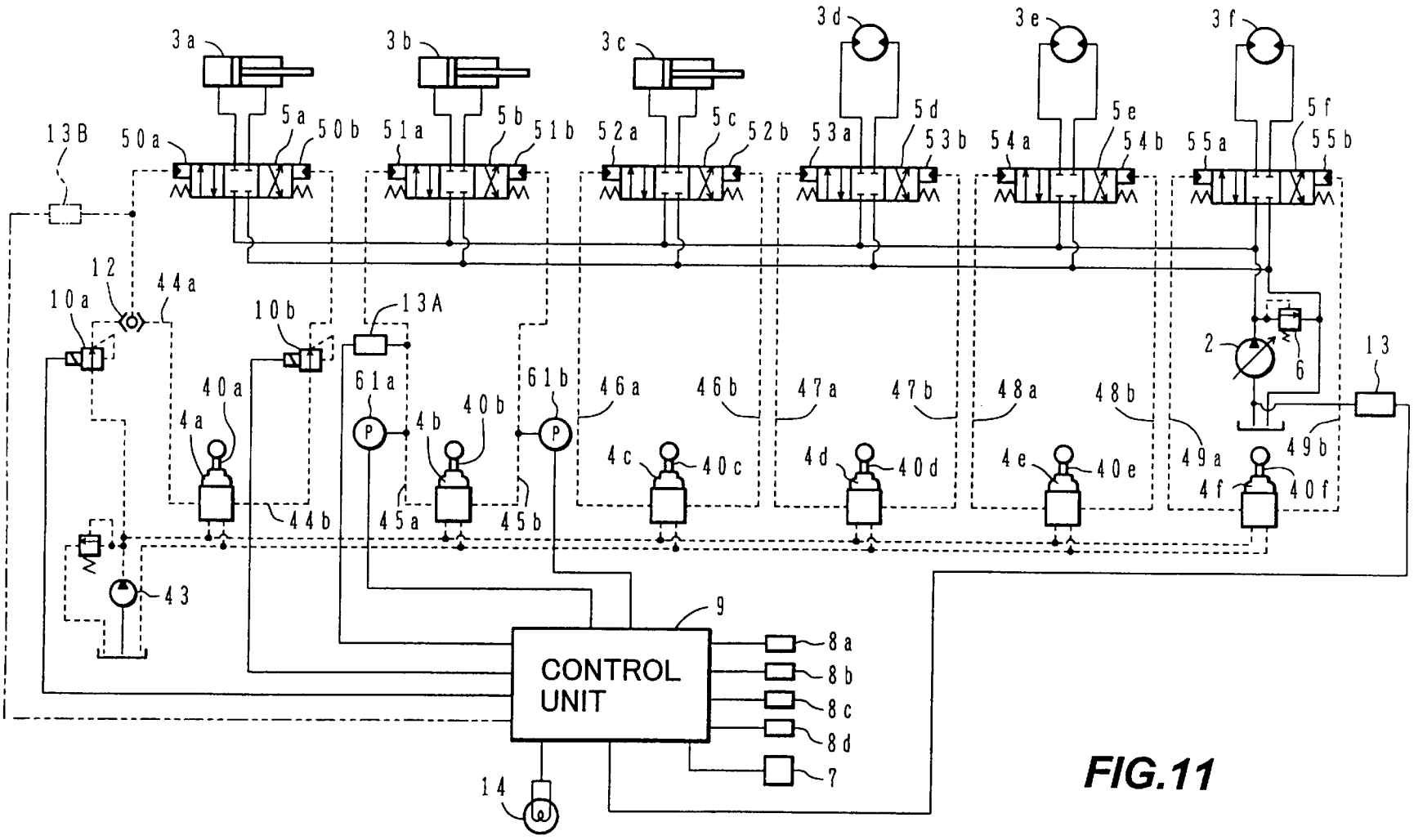
FIG. 11 is a diagram showing a front control system for a construction machine according to a second embodiment of the present invention, along with a hydraulic drive system thereof.

Referring to FIG. 11, an oil temperature sensor 13A is connected to the pilot line 45*a* of the arm control lever unit 4*b* between the pressure sensor 61*a* and the hydraulic driving sector 51*a* of the flow control valve 5*b*. A detection signal from the oil temperature sensor 13A is input to the control unit 9 to carry out the alarm control process of lighting up, blinking or turning out the alarm lamp 14 as with the first embodiment.

The pilot lines 44*a*–49*b* serve to transmit the pilot pressures generated upon operation of the control lever units 4*a*–4*f* to the hydraulic driving sectors 50*a*–55*b* of the flow control valves 5*a*–5*f*, and the transmission of the pilot pressures produces a very small flow of the hydraulic oil in the pilot lines 44*a*–49*b*. Therefore, the hydraulic oil in the pilot lines 44*a*–49*b* is harder to rise in temperature than the hydraulic oil in the main line connected to the hydraulic pump 2. Also, in the present invention, excavation is performed along the boundary L of the set area under the front control, as explained above, when the arm 1*b* is operated in the arm-crowding direction (i.e., when the pilot pressure is generated in the pilot line 45*a*).

In this embodiment, therefore, the oil temperature sensor 13A is connected to the pilot line 45*a*, in which the hydraulic oil is harder to rise in temperature and which directly takes part in the front control, for detecting the oil temperature in the pilot line 45*a*. This enables the operator to obtain information about the oil temperature in a portion directly taking part in the front control, and to perform the area limiting excavation more accurately and safely based on the information.

Another pilot line taking part in the front control is the boom-up pilot line 44*a* in which the pilot pressure is generated to move the boom 1*a* in the boom-up direction when excavation is performed along the boundary L of the set area under the front control. Therefore, a similar advantage as with the above can also be provided by connecting an oil temperature sensor 13B to the pilot line 44*a*, as indicated by imaginary lines in FIG. 11.

An embodiment of the setting device for use in the front control system of the present invention will be described with reference to FIG. 12. In this embodiment, the setting device is constructed of a box-type control panel.

Figure 12:
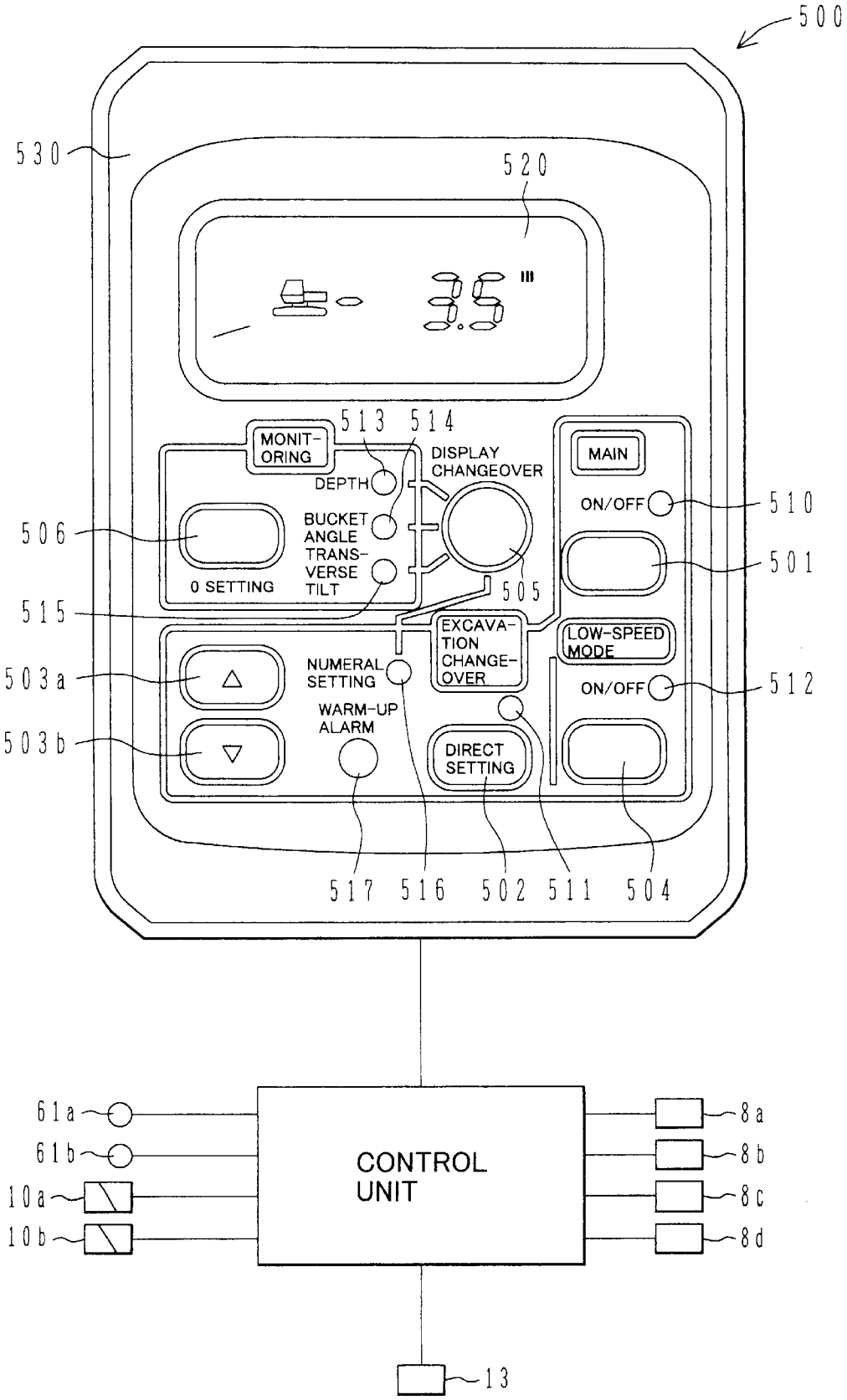
FIG. 12 is a view showing an embodiment of a control panel for use in the front control system of the present invention.

In FIG. 12, denoted by 500 is a box-type control panel. The control panel 500 has various switches such as a main switch 501, a direct setting switch 502, an up-switch 503*a* and a down-switch 503*b* for the numeral input setting, a low-speed mode switch 504, a display changeover switch 505 and a 0-setting switch 506, various LED's 510–516 associated with these switches, a warm-up alarm lamp 517, and a liquid crystal display screen 520. These components are mounted on a panel body 530.

The main switch 501 is to select whether the area limiting excavation control according to the present invention is started or not. When the main switch 501 is pushed (turned on), a control start signal instructing changeover from a normal mode to an area limiting excavation control mode is output to the control unit 9, thus making it possible to perform, e.g., the setting of the excavation area and the area limiting excavation control shown in FIG. 3 and described in connection with the first embodiment. At the same time, the LED 510 is lit up to inform the operator of that the area limiting excavation control mode is now selected.

The direct setting switch 502 is to set an excavation area by the direct teaching described as one example of setting methods in connection with the first embodiment. When the switch 502 is pushed, a direct teaching setting signal is output to the control unit 9, whereupon, as described before, the position of a predetermined part, e.g., the end of the bucket 1*c*, of the front device 1A at that time is calculated and the excavation area is set based on the calculated value. At the same time, the LED 511 is lit up to inform the operator of that the excavation area is being set.

The up-switch 503*a* and the down-switch 503*b* for the numeral input setting are to set an excavation area by inputting a numeral value. When any one of these switches is pushed, a numeral value is increased or reduced in unit of a predetermined amount with 0, for example, as a base, and the input value is indicated on the liquid crystal display screen 520. Also, the input value is applied as a numeral input setting signal to the control unit 9 and the excavation area is set in accordance with the input value. At the same time, the LED 511 is lit up to inform the operator of that the excavation area is being set. Pushing the up-switch 503*a* increases the numeral value and pushing the down-switch 503*b* reduces the numeral value.

The low-speed mode switch 504 is to select whether the area limiting excavation control shown in FIG. 3 and described in connection with the first embodiment, for example, is to be performed in a speed preference work mode or an accuracy preference work mode. When the mode switch 504 is not pushed and kept turned off, the speed preference work mode is selected and the area limiting excavation control can be efficiently performed by using the detection signals from the pressure sensors 61*a*, 61*b* as they are. When the mode switch 504 is pushed and turned on, the accuracy preference work mode is selected so that the detection signals from the pressure sensors 61*a*, 61*b* are reduced in level and the area limiting excavation control can be precisely performed by using the reduced values.

The display changeover switch 505 is to change over the data indicated on the liquid crystal display screen 520. When the switch 505 is pushed to select "DEPTH" shown in FIG. 12, the LED 513 is lit up and the depth (or height) of the end position of the bucket 1*c* calculated in the control unit 9 is indicated on the liquid crystal display screen 520. When it is pushed to select "BUCKET ANGLE", the LED 514 is lit up and the angle of the bucket 1*c* calculated in the control unit 9 is indicated on the liquid crystal display screen 520. When it is pushed to select "TRANSVERSE TILT", the LED 515 is lit up and the transverse tilt angle of the body 1B (see FIG. 2) calculated in the control unit 9 is indicated on the liquid crystal display screen 520. When it is pushed to select "NUMERAL SETTING", the LED 516 is lit up and the excavation area can be set by inputting a numeral value through the up-switch 503*a* and the down-switch 503*b*, as described above.

The 0-setting switch 506 is to set a base for an input value when "DEPTH" and "BUCKET ANGLE" are selected by the display changeover switch 505. When the switch 506 is not pushed and kept turned off, the depth is calculated and indicated with the level of the body 1B on the ground surface as a base (0) for "DEPTH", and the angle is calculated and indicated with the horizontal direction as a base (0) for "BUCKET ANGLE". When the switch 506 is pushed and turned on, the depth is calculated and indicated with the end position of the bucket at that time as a base for "DEPTH", and the angle is calculated and indicated with the direction of the bucket at that time as a base for "BUCKET ANGLE".

The warm-up alarm lamp 517 corresponds to, e.g., the alarm lamp 14 as a part of the oil temperature indicator of the present invention shown in FIG. 1. As described above, when the temperature of the hydraulic oil is in the third oil temperature range C (see FIG. 7), the alarm lamp 517 is not lit up, enabling the operator to recognize that the oil temperature is not low. When the temperature of the hydraulic oil is in the second oil temperature range B (see FIG. 7), the alarm lamp 517 blinks to inform the operator of that the oil temperature is somewhat low. When the temperature of the hydraulic oil is in the first oil temperature range A (see FIG. 7), the alarm lamp 517 is lit up continuously to inform the operator of that the oil temperature is fairly low, and at the same time the area limiting excavation control is forcibly suspended.

The box-type control panel 500 is provided separately from a control panel which is usually equipped in a cab of the hydraulic excavator, for example, forwardly of an operator's seat, and is installed in a position out of interference with a visual field of the operator, e.g., in a front corner of the cab. With the aid of the control panel 500, the operator can easily perform the operation of changing over the control mode and the area setting operation, and also obtain necessary information about the position and posture of the front device. Further, it is possible for the operator to know a current condition of the oil temperature in detail from the warm-up alarm lamp 517 on the control panel 500, and hence carry out the area limiting excavation control accurately and safely.

While typical several embodiments of the present invention have been described hereinabove, the present invention is not limited to those embodiments, but may be modified in various manners.

For example, the alarm lamp is employed in the above embodiments, a buzzer may be used to buzz instead of the alarm lamp.

Also, while the area limiting excavation control is forcibly suspended when the in the oil temperature is fairly low (in the first oil temperature range), the alarm lamp may be only lit up to just inform the operator of that the oil temperature is fairly low. In this case, the area limiting excavation control may be suspended at the discretion of the operator.

While the control lever units of hydraulic pilot type are employed in the above embodiments, electric control lever units may be employed instead.

Also, the above embodiments have been described as using the distance D to the bucket end from the boundary L of the set area for the area limiting excavation control. From the viewpoint of implementing the invention in a simpler way, however, the distance to a pin at the arm end from the boundary of the set area may be used instead. Further, when an area is set for the purpose of preventing interference of the front device with other members and ensuring safety, a predetermined part of the front device may be any other part giving rise to such interference.

While the hydraulic drive system to which the present invention is applied has been described as a closed center system including the flow control valves of closed center type, the invention is also applicable to an open center system including flow control valves of open center type.

While the area limiting excavation control has been described as an example of front control in hydraulic excavators, the invention may also be applied to other types of front control, such as interference preventing control for preventing interference between the front device and a surrounding object.

What is claimed is:

1. A front control system equipped on a construction machine comprising a multi-articulated front device made up of a plurality of front members rotatable in the vertical direction, a plurality of hydraulic actuators for driving respectively said plurality of front members, and a plurality of hydraulic control valves driven in accordance with respective signals input from a plurality of operating means for controlling flow rates of hydraulic oil supplied to said plurality of hydraulic actuators, said front control system controlling said front device to be moved in a preset area, wherein said front control system comprises:

oil temperature detecting means for detecting a temperature of the hydraulic oil, and alarm means for determining in which one of at least three oil temperature ranges including a first oil temperature range, a second oil temperature range higher than said first oil temperature range, and a third oil temperature range higher than said second oil temperature range, the temperature of the hydraulic oil detected by said oil temperature detecting means falls, and issuing an alarm in different ways between said first oil temperature range and said second oil temperature range when the temperature of the hydraulic oil is in said first and second oil temperature ranges.

2. A front control system equipped on a construction machine according to claim 1, wherein said alarm means includes alarm indicating means enabling an operator to visually recognize the alarm, and the alarm is issued by actuating said alarm indicating means.

3. A front control system equipped on a construction machine according to claim 1, wherein said alarm means issues the alarm continuously when the temperature of the hydraulic oil is in the first oil temperature range, and issues the alarm intermittently when the temperature of the hydraulic oil is in the second oil temperature range.

4. A front control system equipped on a construction machine according to claim 3, wherein said alarm means issues the alarm at intervals reducing as the temperature of the hydraulic oil lowers, when the temperature of the hydraulic oil is in the second oil temperature range.

5. A front control system equipped on a construction machine according to claim 1, wherein said alarm means issues the alarm and at the same time forcibly suspends the control of said front device when the temperature of the hydraulic oil is in the first oil temperature range.

6. A front control system equipped on a construction machine according to claim 1, wherein said plurality of operating means are of hydraulic pilot type supplying pilot pressures generated depending on input amounts from said operating means to said plurality of hydraulic control valves through respective pilot lines for driving the corresponding hydraulic control valves, and said oil temperature detecting means is disposed in one of the pilot lines of the hydraulic control valves taking part in the control of said front device for detecting a temperature of the hydraulic oil in the one pilot line.

7. An oil temperature indicator in a front control system for a construction machine including a multi-articulated front device made up of a plurality of front members rotatable in the vertical direction, said front control system controlling said front device to be moved in a preset area, wherein said oil temperature indicator comprises:

oil temperature detecting means for detecting a temperature of the hydraulic oil, alarm indicating means, and alarm control means for determining in which one of at least three oil temperature ranges including a first oil temperature range, a second oil temperature range higher than said first oil temperature range, and a third oil temperature range higher than said second oil temperature range, the temperature of the hydraulic oil detected by said oil temperature detecting means falls, and actuating said alarm indicating means to issue an alarm in different ways between said first oil temperature range and said second oil temperature range when the temperature of the hydraulic oil is in said first and second oil temperature ranges.

8. An oil temperature indicator according to claim 7, wherein said alarm indicating means includes an alarm lamp disposed on a box-type control panel installed in a cab.

9. An oil temperature indicator in a front control system for a construction machine including a multi-articulated front device made up of a plurality of front members rotatable in the vertical direction, said front control system controlling said front device to be moved in a preset area, wherein said oil temperature indicator comprises:

oil temperature detecting means for detecting a temperature of the hydraulic oil, alarm control means for receiving a signal from said oil temperature detecting means and processing the signal through predetermined calculation steps, and alarm indicating means actuated in response to a signal from said alarm control means, and issuing an alarm in different ways between a first oil temperature range and a second oil temperature range in at least three oil temperature ranges including said first oil temperature range, said second oil temperature range higher than said first oil temperature range, and a third oil temperature range higher than said second oil temperature range, when the temperature of the hydraulic oil is in said first and second oil temperature ranges.

10. An oil temperature indicator according to claim 9, wherein said alarm indicating means includes an alarm lamp disposed on a box-type control panel installed in a cab.

* * * * *